United States Patent [19]

Meynier, III

[11] 3,946,806

[45] Mar. 30, 1976

[54] RAM-TYPE BLOWOUT PREVENTER

[75] Inventor: Maurice J. Meynier, III, Houston, Tex.

[73] Assignee: Cameron Iron Works, Inc., Houston, Tex.

[22] Filed: May 1, 1974

[21] Appl. No.: 466,049

Related U.S. Application Data

[62] Division of Ser. No. 263,602, June 16, 1972, Pat. No. 3,817,326.

[52] U.S. Cl. ..... 166/55; 251/1 B; 277/235 R

[51] Int. Cl.[2] ..... E21B 29/00

[58] Field of Search ..... 277/73, 126, 127, 129, 277/235; 251/1, 212; 29/213; 30/92; 222/80; 137/242, 318; 166/55, 55.1, 297

[56] References Cited

UNITED STATES PATENTS

| | | | |
|---|---|---|---|
| 2,246,709 | 6/1941 | Allen | 277/129 |
| 2,919,111 | 12/1959 | Nicolson | 166/55 X |
| 2,969,838 | 1/1961 | Wilde | 166/55 |
| 3,102,709 | 9/1963 | Allen | 251/1 |
| 3,399,728 | 9/1968 | Taylor | 166/55 X |
| 3,399,901 | 9/1968 | Crow et al. | 277/73 X |
| 3,561,526 | 2/1971 | Williams et al. | 166/55 |
| 3,736,982 | 6/1973 | Vujasinovic | 166/55 |

*Primary Examiner*—Martin P. Schwadron
*Assistant Examiner*—Richard Gerard
*Attorney, Agent, or Firm*—Marvin B. Eickenroht; W. F. Hyer

[57] ABSTRACT

There is disclosed a ram-type blowout preventer for shearing a pipe which may be disposed within its bore and then sealing across the bore.

14 Claims, 8 Drawing Figures

12
18A
13B
19A
14
16
10
11
15

15
10
19B
13A
29B
29A
6
6
42
14
18B
17A
16
12

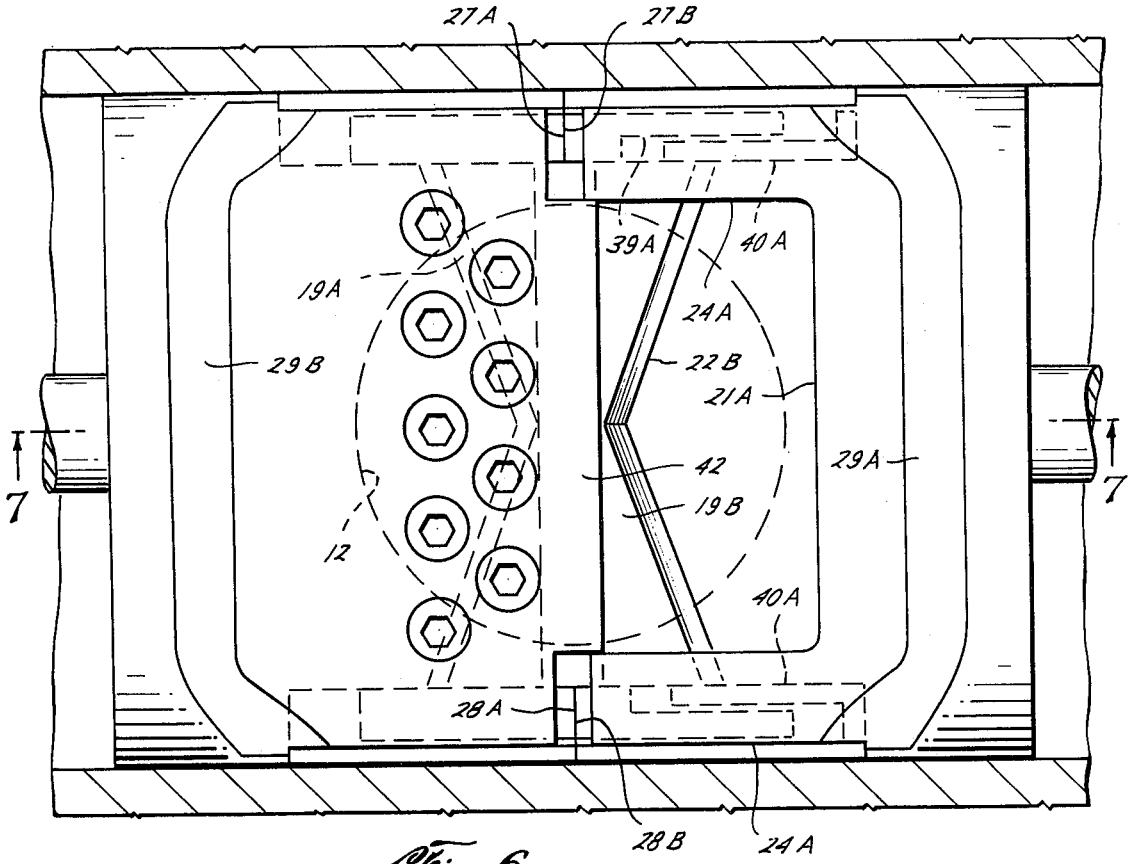
Fig. 6
Fig. 7
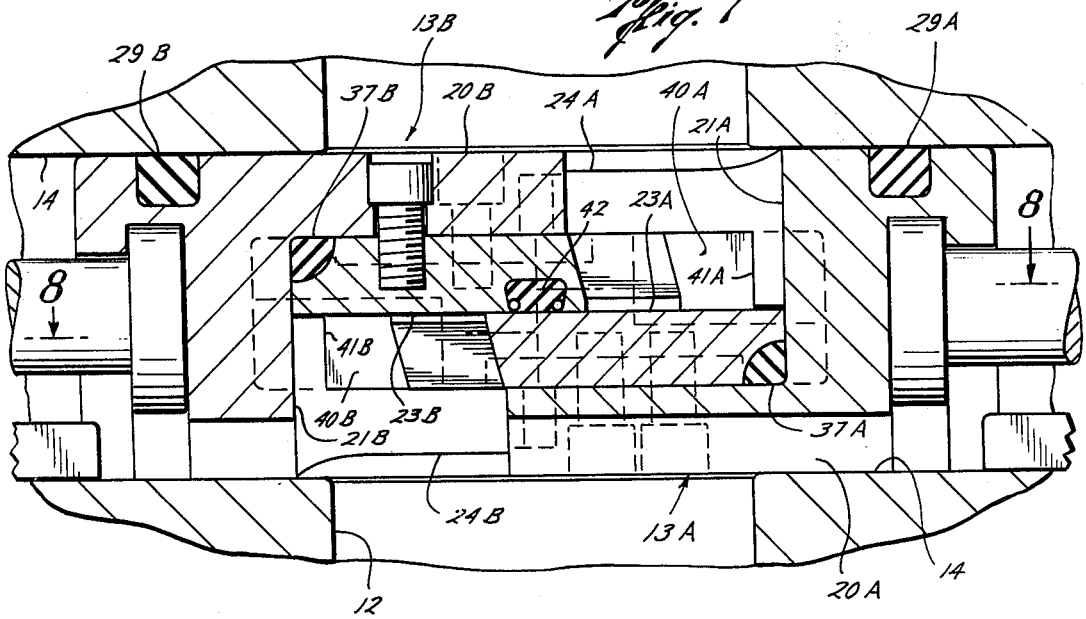

RAM-TYPE BLOWOUT PREVENTER

This is a division, of application Ser. No. 263,602, filed 6/16/72 and now U.S. Pat. No. 3,817,326.

This invention relates generally to ram-type blowout preventers; and, more particularly, to the type of blowout preventer having means on the rams for shearing a pipe which may be disposed within its bore and then sealing across the bore.

As well known in the art, a ram-type blowout preventer comprises a housing having a bore through it and adapted to be connected to a wellhead in alignment with the well bore. Rams are movable within guideways extending from the bore between outer positions removed from the bore and inner positions across the bore and engaging with one another to seal off the bore. The inner ends of the rams may have recesses for sealing about a pipe within the bore, or they may be flat or otherwise complementary for sealing across an open bore.

In the drilling of offshore wells from vessels at the water level, the preventer may be mounted on a wellhead located a considerable distance below water level. In the event of a storm or other emergency condition, it may be desirable to move the vessel from the well site, and circumstances may not permit the drill string to be pulled from the well. In order to meet this and other eventualities, it has been proposed to provide rams with blades having cutting edges for shearing the pipe as the rams move to their inner positions, and with seal means so arranged as to seal between the rams and between each ram and the preventer housing to close the bore upon shearing of the pipe.

One such preventer is shown in U.S. Pat. No. 3,561,526, assigned to the assignee of the present improvement. Some concern has been expressed by users as to whether or not a perfect seal could be attained if the cut ends of the pipe or other junk remain between the rams after shearing. It is therefore an object of this invention to overcome that problem by providing a blowout preventer of this type in which the rams will seal with respect to one another, and thus permit the bore of the preventer to be closed off, even though such junk may be disposed between them.

Another object is to provide a blowout preventer of the type above described in which the seal means of each ram is protected against damage by the sheared pipe as the rams are moved inwardly to shear the pipe and close off the bore.

A further object of the present invention is to provide a blowout preventer of the type above described in which, as in the aforementioned prior patent, the rams seal entirely across their widths.

These and other objects are accomplished, in accordance with the illustrated embodiment of the present invention, by a ram-type preventer in which, as in prior preventers for use in shearing a pipe within the bore through the housing thereof, each ram comprises a body having shearing means including a cutting edge across its inner end and a surface extending outwardly of the cutting edge. More particularly, the ram bodies are arranged in the guideways of the housing for movement in an axial direction with these surfaces facing in opposite directions in generally the same plane so that the cutting edge of each body moves closely past the cutting edge and over the surface of the other body to shear a pipe within the bore as the rams move to their inner positions.

However, as distinguished from the rams of prior preventers of this type, a seal member is carried by one of the ram bodies on and across the width of its surface and substantially flush therewith for disposal opposite the surface of the other ram body, and thus for sealing between said surfaces, when the rams have been so moved. More particularly, this seal member is cooperable with additional seal means portions carried by the ram bodies for sealing between the ram bodies at opposite ends of said seal member and between each ram body and its guideway, so as to seal off the bore of the housing when the ram bodies are moved to their inner positions. Also, the surfaces on the ram bodies are of such outward extent as to provide space for the cut ends of the pipes when the rams have been moved to their inner positions, and thus permit the ram bodies to move to their inner positions to seal off the bore of the housing upon shearing of the pipe therein. More particularly, each surface extends outwardly to a wall which extends from the outer end of the surface to the outside, that is the top or bottom of the ram body, to provide a recess for receiving a cut end of the pipe between the inner end of one ram body and the wall of the other ram body.

In accordance with the preferred embodiment of the invention, said seal means includes faces abuttable with one another so as to deform the seal means and seal member into sealing engagement as said ram bodies move into their inner positions. The seal means also includes parts on their inner sides past which the other ram moves, following abutment of the faces of said seal means, to protect deformable material of the seal means against damage by the ram bodies.

As illustrated, each ram body has flanges which extend from its inner end to provide surfaces which face oppositely to surfaces on said body on opposite sides of the outwardly extending surfaces on the body, and said seal means comprise side seal parts disposed between said oppositely facing surfaces on the body to engage on their sides with the guideways and with opposite ends of the seal member carried by one of the ram bodies.

In the drawings, wherein like reference characters are used throughout to designate like parts:

FIG. 6 is a top view of the rams within the guideways, and moved to their inner positions, as seen along section line 6—6 of FIG. 2;

FIG. 7 is a vertical cross-sectional view of the rams, as seen along line 7—7 of FIG. 6.

Figure 1:
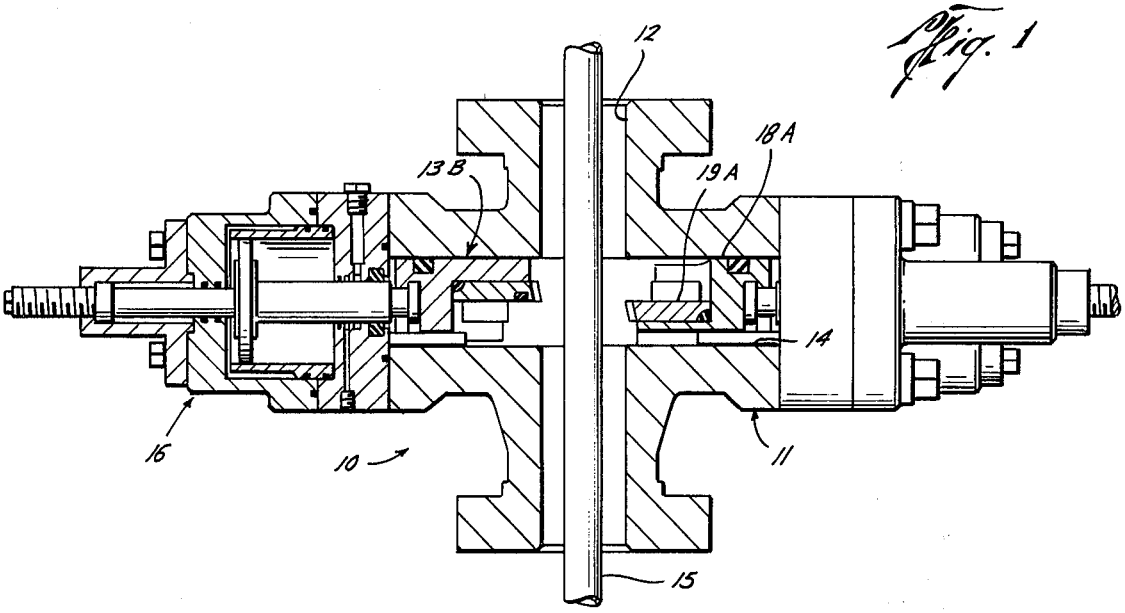
FIG. 1 is a side view, partly in section and partly in elevation, of a blowout preventer constructed in accordance with the present invention, and with the rams thereof in their outer positions.
Figure 2:
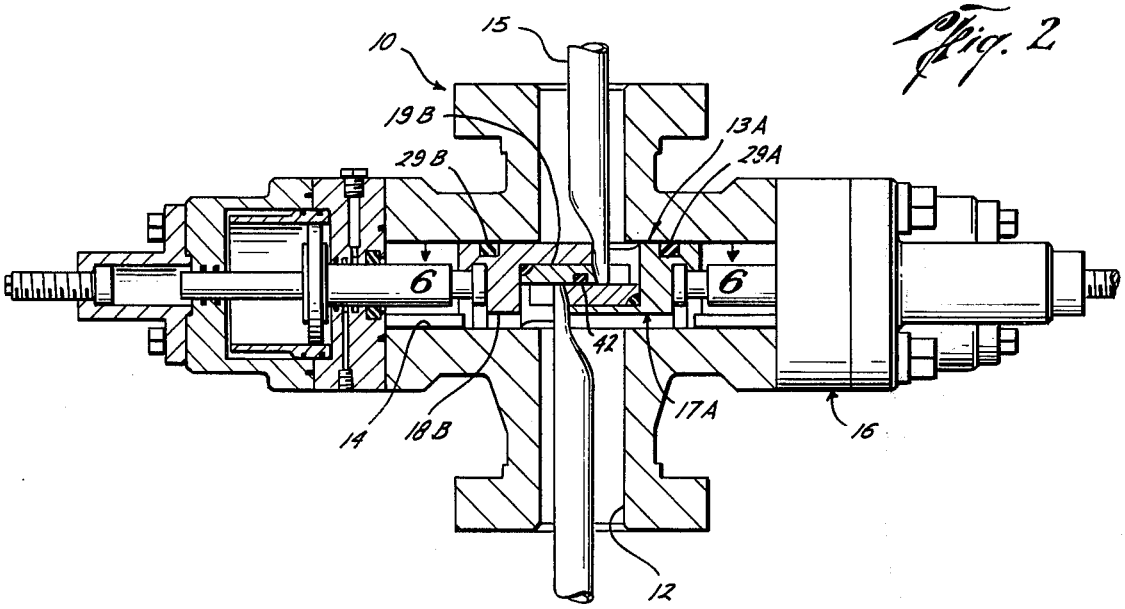
FIG. 2 is a view similar to FIG. 1, but with the rams moved to their inner positions to shear a pipe in the bore of the preventer and seal off the bore.

With reference now to the details of the abovedescribed drawings, the over-all preventer 10 is shown in FIGS. 1 and 2 to comprise a housing 11 having a bore 12 therethrough and a pair of rams 13A and 13B movable axially within guideways 14 extending laterally from opposite sides of the bore. The lower end of the housing is adapted to be connected to a wellhead in axial alignment with the bore of an underwater well, which may be disposed a substantial distance beneath the water level. The rams are shown in FIG. 1 in their outer positions, wherein they are removed from the bore 12 of the housing to permit a drill pipe 15 to extend therethrough and thus into the well bore.

The rams are caused to move between the outer position of FIG. 1 and the inner position of FIG. 2 by means of operators 16 connected to the housing at the outer ends of the ram guideways 14. These operators include reciprocating hydraulic actuators releasably connected to the outer ends of the rams, as by means of "T" slots, as well known in the art. Reference may be had, for example, to U.S. Pat. No. 3,272,222 for a detailed description of the construction and function of operators 16, including their releasable connection to the preventer housing to permit installation and removal of the rams. As will be described below, when moved to their inner positions, the rams shear pipe 15 and then seal off the bore so as to contain well fluid therebelow.

Figure 3:
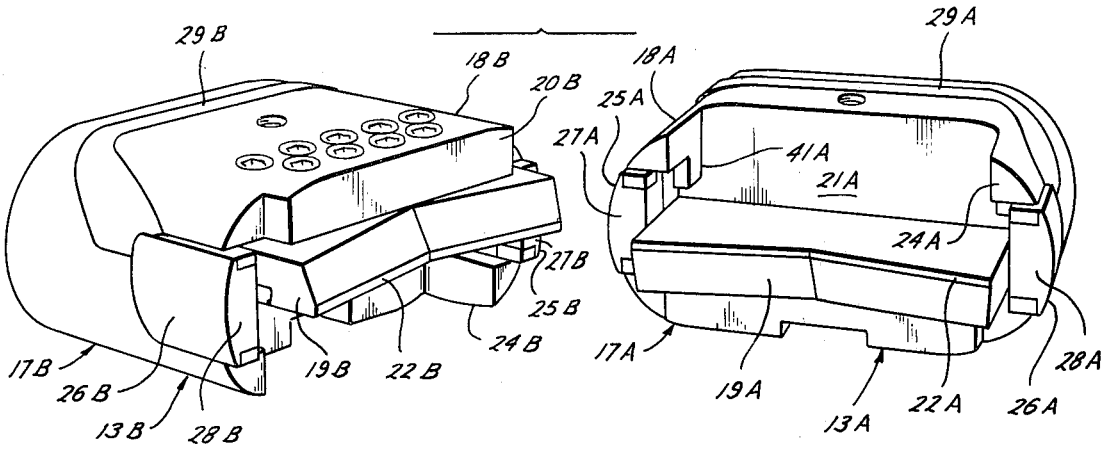
FIG. 3 is an isometric view of the rams removed from the guideways in the preventer housing.
Figure 4:
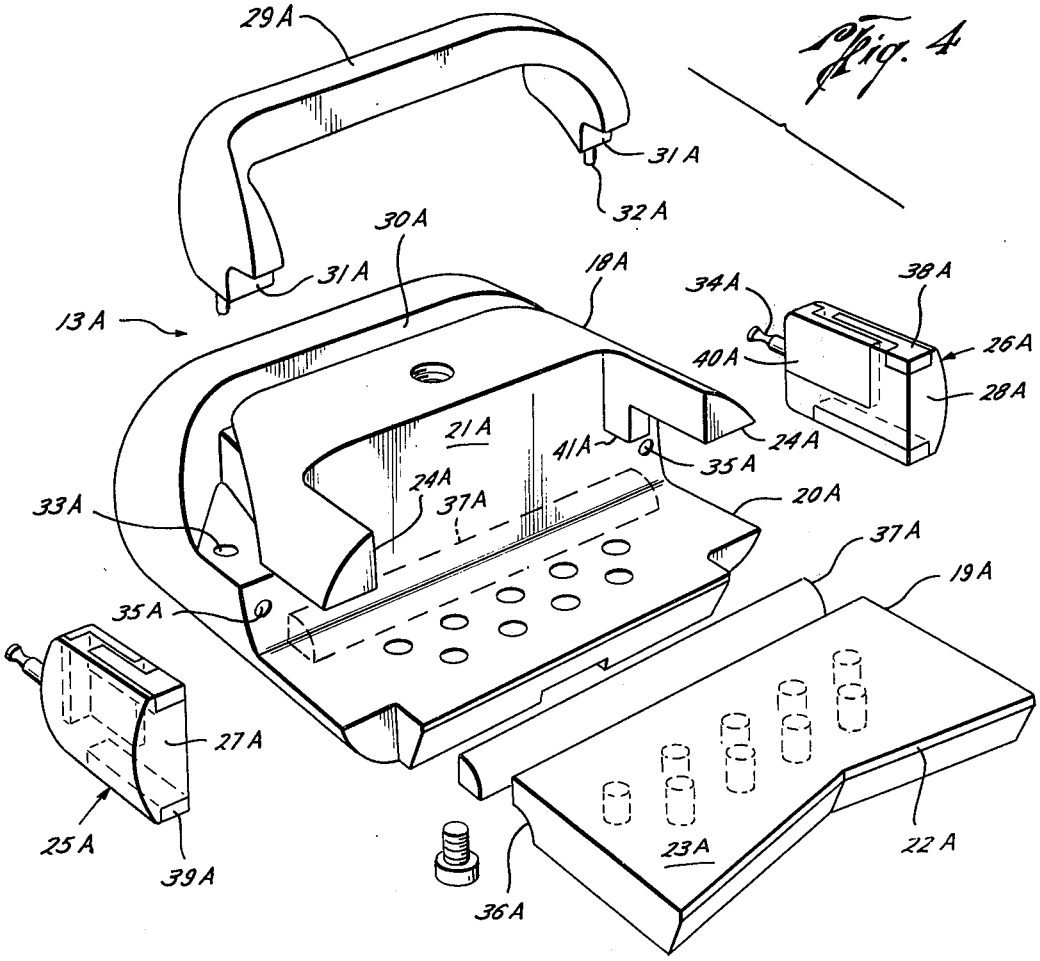
FIG. 4 is an exploded view of the right-hand ram, as seen from the top and one side thereof.

As best shown in FIGS. 3 and 4, ram 13A comprises a body 17A consisting of a carrier 18A and a shear blade 19A removably mounted thereon. The carrier has inner and outer ends, and a top and bottom and opposite sides which slide axially within its guideway in response to operation of the operator 16 connected to its outer end. As shown, the opposite sides of the carrier are curved for fitting closely within its guideway. The bottom of the carrier 18A includes a flange 20A which extends entirely across its inner end to provide an upwardly facing surface on which the blade 19A is mounted. When so mounted, the blade is releasably secured to the carrier by means of bolts extending through aligned holes in the flange and bottom side of the blade.

The inner end of blade 19A projects beyond the inner end of flange 20A and has a cutting edge 22A which is of a wide "V" shape for cooperation with a similarly shaped cutting edge on the blade of the other ram 13B, as will be described below. With the balde mounted on the carrier, its top surface 23A is disposed in a plane perpendicular to the axis of the bore 12 and equidistant from the top and bottom of the carrier. The blade 19A is not as wide, from side to side, as the flange 20A, so that when it is mounted on the carrier, its opposite sides are spaced from the opposite sides of the carrier.

A wall 21A extends vertically upwardly from the rear end of the upwardly facing surface provided by the flange 20A to intersect the top of the carrier intermediate its inner and outer ends, and the space above this surface is unobstructed to provide a recess to receive the blade of the other raam and the upper cut end of a pipe. A pair of flanges 24A extend forwardly from the upper, outer corners of wall 21A to provide surfaces which are axially coextensive with and which are parallel and face oppositely to the opposite ends of the upwardly facing surface of flange 20A. More particularly, these downwardly facing surfaces on flanges 24A are spaced above the upwardly facing surfaces of the flange 20A a distance approximately twice the thickness of the blade 19A so as to permit a blade of the same thickness on the left-hand ram 13B to be moved into the space between the top of blade 19A and the flanges 24A, as will be described below.

The seal means mounted on the carrier 18A includes side seal parts 25A and 26A adapted to be mounted on the sides of the carrier, each between a flange 24A and the oppositely facing surface of flange 20A. The outer sides of the side seal parts are curved to form continuations of the curved sides of the ram body carrier for sliding within a guideway 14, and the inner sides of such parts face the opposite sides of the recess.

The side seal parts 25A and 26A abut the vertical wall 21A, and protrude inwardly beyond flanges 24A and 20A. Thus, they provide vertical faces 27A and 28A, respectively adapted to abut similar faces on ram 13B, as will also be described below.

The seal means mounted on carrier 18A also includes a top seal part 29A which is substantially U-shaped and adapted to fit closely within a similarly shaped groove 30A formed over the top and along the opposite sides of the ram body carrier 18A. The opposite ends of the top seal part 29A are notched at 31A so as to fit closely adjacent the upper rear corners of the side seal parts 25A and 26A to provide a continuous sealing surface over the top of the ram and along its opposite sides to its inner end. Top seal part 29A is curved so as to form substantially a continuation of the top and sides of the ram carrier 18A.

It will be understood that these parts of the seal means of ram 13A are similar in construction and function to corresponding portions of the rams of the preventer of the aforementioned U.S. Pat. No. 3,272,222. That is, as will be apparent from FIGS. 1 and 2, the top seal part 29A and side seal parts 25A and 26A are confined by the guideway 14 in both the inner and outer positions of the ram. Consequently, with the ram in its inner position, these seal parts will, upon deformation in response to engagement with the other ram 13B, provide a continuous seal between the ram and guideways across its top and along its sides.

Figure 8:
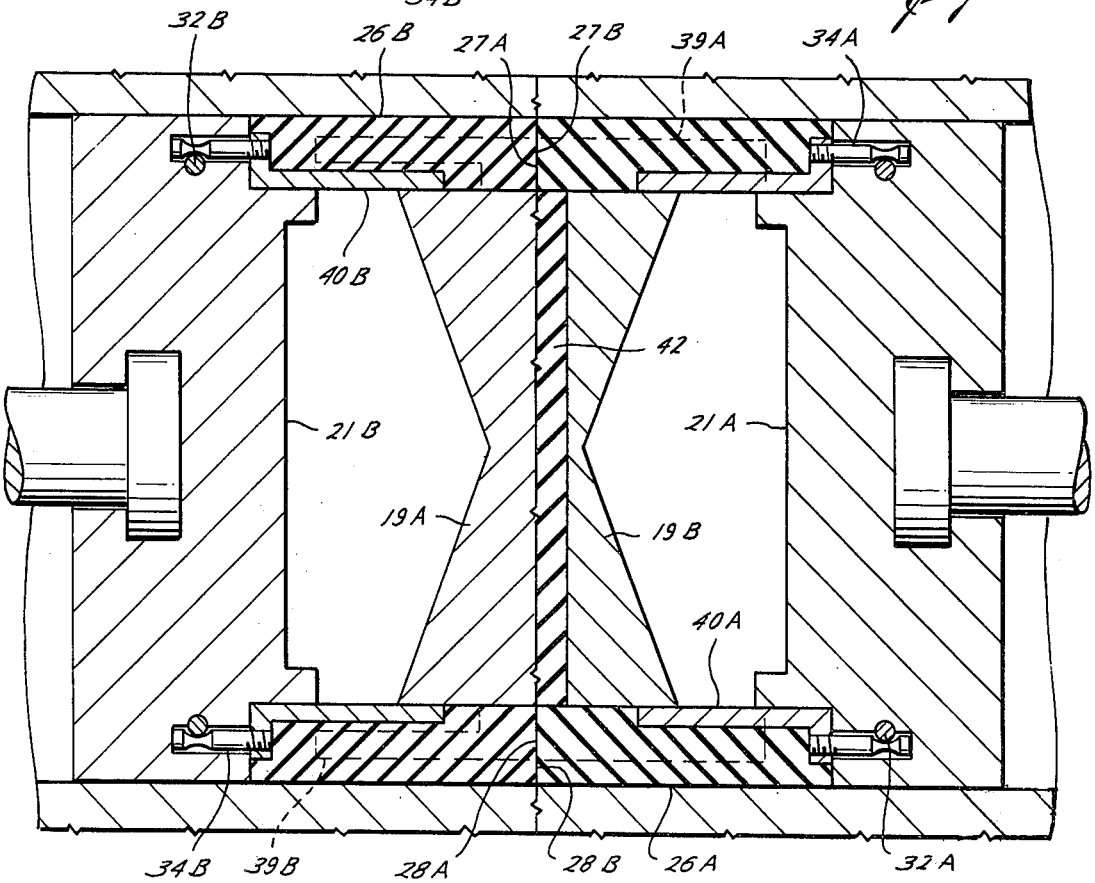
FIG. 8 is a horizontal sectional view of the rams of FIG. 7, as seen along section line 8—8 of FIG. 7.

The opposite ends of the top seal part are provided with pins 32A which are adapted to fit within holes 33A formed in the groove 30A near its opposite ends. Also, a pin 34A extends from the rear end of each side seal part 25A and 26A for fitting within a hole 35A formed in the wall 21A of the carrier near its opposite sides. The holes 33A and 35A on opposite sides of the carrier intersect, and the other ends of the pins 34A are grooved so that with the side seal parts first mounted on the carrier, the top seal part 29A may be moved into position to cause the lower ends of its pins 32A to engage in the grooved portions of the side seal part pin 34A, as shown in FIG. 8, and thus lock the side seal parts in place on the carrier.

The outer bottom corner of blade 19A is grooved at 36A to receive a seal part 37A of deformable material for extension across the width of the blade so as to dispose its opposite ends adjacent the inner sides of the side seal parts 25A and 26A. Thus, when the seal part 37A is deformed by deformation of the side seal parts, its prevents well fluid from by-passing the blade.

As best shown in FIG. 4, each side seal part comprises a body of deformable sealing material having thin rigid plates 38A, 39A and 40A molded to its top, bottom and inner sides, respectively. Each of the top and bottom plates extends lengthwise of each side seal part from its front end for less than its entire length, and each inner plate 40A extends vertically from the top of each side seal part for less than its height and from its rear end longitudinally for less then its length. Top plate 38A has a rearwardly extending leg which is spaced from and along the outer side of side plate 40A, and the side plate has an outwardly extending flange at its outer end which is spaced from and rearward of the rear end of the leg of the top plate. These flanges on the outwardly extending flanges on the side plate 40A support the pins 34A. The inner ends of plates 38A and 39A extend across most of the width of the side seal parts, and thus prevent the deformable sealing material thereof from being extruded between adjacent faces of the carriers.

The lower edge of each inner plate 40A extends below the top surface 23A of blade 19A, and a leg 41A extends downwardly from the lower surface of each flange 24A to provide a surface closely adjacent the upper rear corner of the plate 40A, which surface cooperates with shear blade 19A to prevent plate 40A from being pushed into the space in which the blade of the other ram is to be received.

Figure 5:
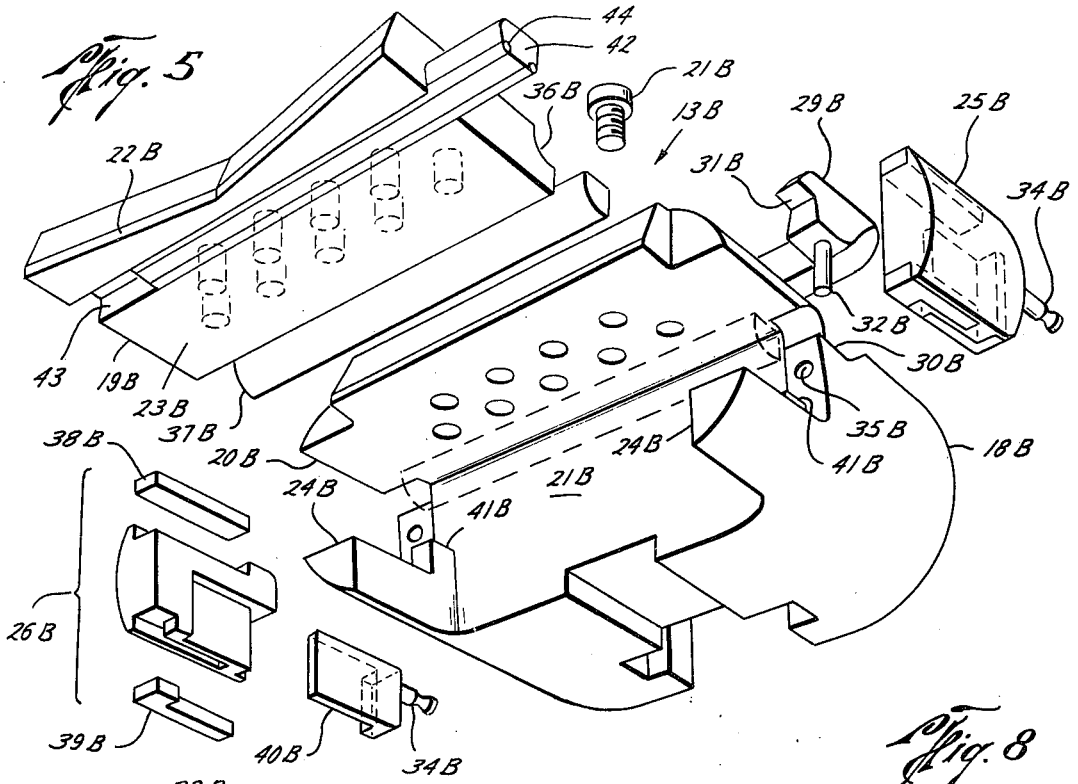
FIG. 5 is an exploded view of the left-hand ram, as seen from the bottom and one side thereof.

As best shown in FIGS. 3 and 5, ram 13B is quite similar to ram 13A, in that is comprises a body 17B consisting of a shear blade 19B removably mounted on a carrier 18B. Also, the carrier 18B has inner and outer ends, and a top and bottom and opposite sides which are caused to slide axially within a guideway by an operator mounted across the outer end of the guideway. The carrier has a flange 20B extending across its inner end to provide a surface on which the blade is mounted, and a vertical wall 21B at the outer end of the surface on the flange to provide a recess for receiving the blade 19A of ram 13A and the lower cut end of a pipe. However, when the ram 13B is assembled in its quideway 14, these parts are reversed top for bottom with respect to the corresponding parts of ram 13A. Thus, flange 20B extends inwardly from the top of carrier 18B to provide a downwardly facing flat surface to which the top side of blade 19B is secured by bolts which extend through aligned holes in flange 20B and top side of plate 19B. Also, wall 21B extends downwardly to intersect the bottom of the carrier intermediate its inner and outer ends.

The blade 19B has a "V" shaped cutting edge 22B and projects forwardly of the inner end of the carrier to provide a surface 23B — in this case downwardly facing — which is disposed in a plane perpendicular to the axis of bore 12. More particularly, blade 19B is of the same size as blade 19A, and its surface 23B is approximately equidistant from the top and bottom of the carrier. Thus, as will be more fully understood from the description to follow, when the rams 13A and 13B are mounted in their guideways, the top and bottom surfaces, respectively, of their blades are disposed in substantially the same plane, so that during movement of the rams to their inner positions, the cutting edges of each will shear the pipe 15 by moving past one another and over the surface of the other.

As in the case of blade 19A of ram 13A, the opposite sides of blade 19B are spaced inwardly from the opposite sides of carrier 18B. Also, the space below the bottom surface 23B of the blade is unobstructed, except for a pair of flanges 24B which extend forwardly from the lower, outer corners of wall 21B. The tops of these flanges provide surfaces which are axially coextensive with and which are parallel and face oppositely to the opposite downwardly facing surfaces at the sides of the flange 20B. Flanges 24B are spaced below the surfaces of flange 20B a distance approximately twice the thickness of plate 19B so as to permit blade 19A to be moved into the space between blade 19B and flanges 24B, as blade 19B simultaneously moves into the space between blade 19A and flanges 24A of ram 13A.

More particularly, the shear blades are of such length end-for-end that, when moved to their inner positions, they will overlap for a considerable axial distance, so as to dispose a seal member 42 carried on and extending across surface 23B of blade 19B opposite the upwardly facing surface 23A of blade 19A, and at the same time leave a substantial space between the inner end of each ram and the vertical wall of the other ram to receive the cut ends of the pipe. As best shown in FIG. 5, seal member 42 is somewhat enlarged across its top and is slidable into and out of a groove 43 of conforming cross section. When in the groove, it provides a lower surface which forms a continuation of surface 23B so that is will move freely over surface 23A as the rams are moved into and out of their inner positions. However, when the rams are moved into their inner positions, the seal member is deformed to cause its lower surface to protrude and thus sealingly engage blades 19A and 19B across their entire widths. The lower edges of seal member 42 are retained against extrusion by means of imbedded elongate coil springs 44.

In other respects, the construction and function of ram 13B will be understood from the foregoing description of ram 13A, and hence corresponding parts have been given corresponding reference characters, with those of rams 13B using the letter "B" rather than the letter "A".

Thus, as best illustrated in FIG. 6, the protruding faces 27A and 27B, as well as 28A and 28B, of the seal means of the rams abut one another only after shearing of the pipe 15 and movement of the blades into an overlapping position in which the seal member 42 is opposite the surface 23A of the blade 19A of the ram 13A, but before final movement of the rams into their inner positions. Upon continued inward movement of the rams, the abutting faces are forced against one another to deform the deformable sealing material of the side seal parts, which deformation is in turn transmitted to top seal parts 29A and 29B, to seal parts 37 and 38, and to seal member 42. Consequently, when the rams have been moved to their inner positions, all such portions have been deformed to provide a continuous seal between one ram and the other as well as between each ram and its guideway so as to seal off the upper end of the bore 12.

This continuous seal includes the sealing engagement of the inner side of each side seal part of each ram with the side of the blade of the other ram. However, as will be apparent from FIGS. 6 and 7, the side plates 40A and 40B on the side seal parts of the two rams are of such axial length that the shear blades move past the front edges of such plates prior to abutment of the side seal parts with one another, and thus prior to deformation of the deformable sealing material. Consequently, the shear blades are prevented from damaging the side seal parts during continued movement of the rams in an inward direction. Thus, as indicated above and and as shown in the drawings seal member 42 is substantially flush with surface 23B and is adapted to seal against surface 23A (the latter being complementary to surface 23B) when the rams are in closed position. Also, the groove 43 can be termed a means adapted to mount seal member 42 substantially flush with surface 23B.

Further, surface 23A can be said to extend in an axial direction and to terminate in cutting edge 22B.

Although it is preferred that the surfaces 23A and 23B of the rams 13A and 13B, respectively, be flat and disposed in planes perpendicular to the axis of the bore 12 of the preventer housing, it is comtemplated that such surfaces may instead be other than perpendicular to the axis of the bore of the preventer housing, and even curved as long as all straight line elements on the surface are parallel to the axis of the ram. In any event, however, the surfaces extend across the rams for a sufficient extent to provide cutting edges which cooperate with one another in shearing the pipe in the bore.

Also, although it is preferred that the shear blades be removable from the ram carriers, they may instead be made integral therewith. Still further, the seal member 42 could instead be mounted on the upwardly facing surface of the ram 13A; and, in fact, two such seal members may be provided, one on each such surface and positioned either to engage one another or engage axially spaced-apart portions of the surfaces opposite to which they are disposed.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A side seal part for blowout preventer ram comprising a body of deformable sealing material having front and rear ends, horizontal sides, and vertical sides, a first rigid plate secured to a first horizontal side of the body and extending rearwardly from its front end for less than its length, a second rigid plate secured to a second horizontal side of the body and extending rearwardly from its front end for less than its length, the front end of each of the first and second plates extending across substantially the entire width of the front end of the body at the upper and lower portions thereof, and a third rigid plate secured to a first vertical side of the body and extending forwardly from its rear end for less than its length and vertically from its first horizontal side for less than its height.

2. A side seal part of the character defined in claim 1, wherein the first plate includes a narrow leg extending rearwardly from its front end along and spaced from the inner side of said third plate.

3. A side seal part of the character defined in claim 2, wherein the third plate includes a flange extending from its rear end to a position spaced from and behind the end of the leg.

4. A side seal part of the character defined in claim 3, including a pin secured to the flange and extending rearwardly therefrom.

5. For use as a part of a blowout preventer ram having a carrier which is longitudinally movable within a guideway of a blowout preventer housing, a blade adapted to be mounted on the carrier for movement therewith, said blade having a cutting edge extending substantially from one side to the other thereof, a surface extending from said edge, and a groove in the surface extending from one side to the other thereof, and a sealing member in said groove.

6. A blade of the character defined in claim 5 having means thereon for connecting it to the ram body carrier.

7. A blade of the character defined in claim 5, wherein the opposite ends of the sealing member are substantially flush with the sides of the blade.

8. A blade of the character defined in claim 7, wherein said groove is dove-tailed in cross section.

9. A blade of the character defined in claim 5, wherein the groove in the blade is near the cutting edge thereof.

10. For use as a part of a blowout preventer ram having a carrier which is longitudinally movable within a guideway of a blowout preventer housing, a blade adapted to be mounted on the carrier for movement therewith, said blade having upper and lower surfaces, inner and outer ends, and opposite sides, a cutting edge extending across the inner end of the blade, a groove in one of the surfaces of the blade extending from one side to the other thereof, and a sealing member in said groove.

11. A blade of the character defined in claim 10, wherein the other surface of the blade has means thereon for connecting the blade to the ram carrier for movement therewith.

12. A blade of the character defined in claim 10, wherein said blade has another groove extending from one side to the other thereof at the intersection of its other surface and outer end.

13. A blade of the character defined in claim 10, wherein the opposite ends of the sealing member are substantially flush with the sides of the blade.

14. A blade of the character defined in claim 13, where said groove is dove-tail in cross section.

* * * * *